United States Patent [19]

Moran et al.

[11] Patent Number: 4,613,450

[45] Date of Patent: Sep. 23, 1986

[54] ANTICORROSION MEANS AND COMPOSITIONS CONTAINING SAME

[75] Inventors: Francis Moran, Paris; Sylvain Rocher, Le Mans; Louis Cot, Castelnau le Lez; Francis Dabosi, Ramonville Saint Agne; Michel Duprat, Castanet Tolosan; Jean Durand, Montpellier, all of France

[73] Assignee: Union Chimique et Industrielle de l'Ouest, France

[21] Appl. No.: 715,918

[22] Filed: Mar. 25, 1985

Related U.S. Application Data

[63] Continuation of Ser. No. 497,572, May 24, 1983, abandoned.

[30] Foreign Application Priority Data

May 28, 1982 [FR] France ..... 82 09426

[51] Int. Cl.[4] ..... C02F 5/10

[52] U.S. Cl. ..... 252/181; 106/14.12; 422/18

[58] Field of Search ..... 106/14.12; 252/181, 252/175; 422/18

[56] References Cited

U.S. PATENT DOCUMENTS 4,132,572 1/1979 Parant et al. ..... 106/14.12

FOREIGN PATENT DOCUMENTS 0010485 4/1980 France .

*Primary Examiner*—Lorenzo B. Hayes

*Attorney, Agent, or Firm*—Ostrolenk, Faber, Gerb & Soffen

[57] ABSTRACT

This invention relates to a corrosion inhibitor for protecting metallic surfaces which are in contact with water, in particular circuits, apparatus and devices which use water as energetic or thermic fluid, said corrosion inhibitor being a fluorophosphate compound selected from the group consisting of:

(i) compound of the formula $M_2^{I}PO_3F$, $xH_2O$ (ii) compound of the formula $LiM^{I}PO_3F$, $xH_2O$ (iii) compound of the formula $NaM^{I}PO_3F$, $xH_2O$ (iv) compound of the formula $M^{II}PO_3F$, $xH_2O$ (v) compound of the formula $M_2^{I}M^{II}(PO_3F)_2$, $xH_2O$ (vi) compound of the formula $M^{I}PO_2F_2$, $xH_2O$ (vii) compound of the formula $M^{II}(PO_2F_2)_2$, x $H_2O$ (wherein $M^{I}$ is Na, K, Rb, Cs or $HN_4$; $M^{II}$ is Mg, Ca, Ba, Sr, Zn, Cd, Mn, Ni or Co; and x is an integer or a fractional number comprised between 0 and 6) and (viii) mixtures thereof.

6 Claims, No Drawings

ANTICORROSION MEANS AND COMPOSITIONS CONTAINING SAME

This application is a continuation of application Ser. No. 497,572 filed May 24, 1983, now abandoned.

The present invention relates to a new corrosion inhibitor belonging to the fluorophosphate family, for protecting metallic surfaces, particularly those of installations and devices using water as energetic or thermic fluid. The invention also relates to a composition containing this inhibitor in association, if necessary, with one or more other substances useful in the domain of protection against aqueous corrosion.

It is known that any metallic surface currently used in industry and any equipment composed of one or more metals such as iron and its alloys, particularly galvanized steel, copper and its alloys, aluminum and its alloys, to mention only those most employed, are subjected, upon contact with water, to the phenomena of corrosion which are all the greater and more accumulative as fresh water is supplied frequently or in large quantities in installations, circuits or devices using water as energetic or thermic fluid.

A certain number of technical solutions have been proposed in the past to solve the problem of the protection of metallic surfaces against corrosion. Among recent solutions which have proved effective are those described in European Patent No. 10485 and in European Patent Application No. 81400861 which employ compositions containing either at least one polyamine and at least one alkylenephosphonic acid derivative, or at least one polyamine and at least one organic polyelectrolyte resulting from polymerization or copolymerization of a monomer having a C=C double bond.

Furthermore, it is known, particularly by U.S. Pat. No. 4,132,572, that fluorophosphates (also known as "oxyfluorinated derivatives of phosphorus 5") are substances known to be means for treating metallic surfaces before painting.

According to the invention, a new technical solution for solving the problem of protecting metallic surfaces against aqueous corrosion is recommended, which employs new inhibitor means which are structurally different from the means previously known in the domain of corrosion inhibition.

This new solution is particularly advantageous for protecting from aqueous corrosion the metallic surfaces of installations, circuits and devices using liquid water (raw water, demineralized water, synthetic water, industrial water which may in particular contain an antifreeze, salt water such as sea water, aqueous mud, particularly for oil drilling, etc. . .) as energetic or thermic fluid (cooling or heating circuits).

The new corrosion inhibitor according to the invention which belongs to the family of fluorophosphates is characterized in that it is selected from the group consisting of:

(i) compound of the formula $M_2^IPO_3F$, $xH_2O$
(ii) compound of the formula $LiM^IPO_3F$, $xH_2O$
(iii) compound of the formula $NaM^IPO_3F$, $xH_2O$
(iv) compound of the formula $M^{II}PO_3F$, $xH_2O$
(v) compound of the formula $M_2^IM^{II}(PO_3F)_2$, $xH_2O$
(vi) compound of the formula $M^IPO_2F_2$, $xH_2O$ and
(vii) compound of the formula $M^{II}(PO_2F_2)_2$, $xH_2O$ (wherein $M^I$ is Na, K, Rb, Cs or $HN_4$; $M^{II}$ is Mg, Ca, Ba, Sr, Zn, Cd, Mn, Ni or Co; and x is an integer or a fractional number comprised between 0 and 6) and
(viii) mixtures thereof.

The preferred corrosion inhibitors according to the invention are zinc and potassium fluorophosphates, namely $ZnPO_3F$ and $K_2PO_3F$, the most interesting being $ZnPO_3F$.

The fluorophosphates according to the invention are substances which are generally sparingly water-soluble, the threshold of solubility in water being of the order of 10 g/l.

This weak water-solubility is not a hindrance having regard to the quantities to be used. In fact, it has been observed that, to protect the metallic surfaces against aqueous corrosion, a dose of 3 to 500 ppm of inhibitor according to the invention should be used, and preferably a dose between 5 and 200 ppm, particularly for $ZnPO_3F$. On this subject, it is noted that, with respect to raw water A and synthetic water B described hereinafter, the dose of $ZnPO_3F$ giving maximum inhibition is from 20 to 25 ppm (cf. Table III hereinbelow).

According to an embodiment of the invention, a corrosion inhibitor is recommended which is characterized in that it contains in solution or aqueous suspension a corrosion inhibitor selected from the group of the fluorophosphates of (i) to (viii) hereinabove. This composition is used so that, after introduction into the corrosive aqueous fluid, the content of the inhibitor is from 3 to 500 ppm by dry weight (preferably from 5 to 200 ppm by weight particularly for $ZnPO_3F$) with respect to the weight of the fluid.

According to another embodiment of the invention, an anti-corrosion composition is recommended which comprises, in association in water:

A - a corrosion inhibitor selected from the family of fluorophosphates as defined hereinabove, and B - a substance selected particularly from the group consisting of polyamines, organic polyelectrolytes resulting from polymerization or copolymerization of a monomer having a C=C double bond, alkylenepolyphosphonic acid derivatives, aminoalkylenephosphonic acid derivatives and mixtures thereof.

With respect to the use of means A and B alone, the association of A and of B presents a synergy concerning the inhibition of corrosion.

Among substances B which may be used, the means described in the European Patent and the European Patent Application mentioned above and mixtures thereof may be employed.

Among suitable polyamines, those responding to the general formula $$R\text{-}[NH\text{-}(CH_2)_m]_nNH_2 \quad (I)$$

(wherein R is a saturated or unsaturated aliphatic $C_{12}$–$C_{22}$ hydrocarbon radical, m represents an integer between 2 and 8 inclusive and n represents an integer between 1 and 7 inclusive), and mixtures thereof are recommended.

The amines of formula I may be used as found on the market, alone or mixed with one another, in their pure or technical forms. Polyamines prepared from fatty acids of animal, vegetable or synthetic origin may also be used. Among suitable polyamines on the market, particular mention may be made of the products known under the trade names DUOMEEN, DINORAM, TRINORAM, POLYRAM, LILAMIN and CEMULCAT which contain at least one polyamine according to formula I. Among the latter products, particular mention may be made of "DINORAM O" which contains approximately 75% by dry weight of oleylaminopropyleneamine, 9% by dry weight of stearylaminopropyleneamine and 6% by dry weight of hexadecylaminopropyleneamine, and "DINORAM S" which contains approximately 43% by dry weight of stearylaminopropyleneamine, 28% by dry weight of oleylaminopropyleneamine and 28% by dry weight of hexadecylaminopropyleneamine, these products being marketed by the firm CECA.

Among the polyelectrolytes which may be used as substances B, polymeric organic polyelectrolytes having a molecular weight greater than or equal to about 150 and preferably a molecular weight greater than or equal to 300 are recommended. The upper limit of the molecular weight may be very high, and in particular of the order of 2 000 000 or more. Among suitable polyelectrolytes, particular mention may be made of the polymers and copolymers obtained from acrylic acid, its esters and salts, methacrylic acid, its esters and salts, acrylamide, methacrylamide, maleic acid, esters and salts thereof.

These polyelectrolytes are generally polymer substances obtained by polymerization, copolymerization or terpolymerization from a monomer which may be schematically represented by the formula

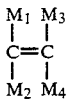

(II)

in which $M_1$, $M_2$, $M_3$ or $M_4$, which may be identical or different, each represent an atom of hydrogen, a $C_1$–$C_4$ alkyl group, or a cyano, aldehyde, alcohol, amine, amide, imine, imide, ammonium, $CO_2M$ or $SO_3M$ group (where M is H, $C_1$–$C_4$ alkyl, $NH_4^+$ or a metallic cation, particularly $Na^+$ or $K^+$).

The definitions given hereinabove for formula II encompass the copolymers obtained from ethylene and its ethylenic analogs ($M_1$, $M_2$, $M_3$ and $M_4$ each representing H or alkyl). However, to obtain polymers and copolymers of the acrylic, acrylate, acrylamide, acrylaldehyde, acrylonitrile, maleic type in particular, it is clear that at least one of the $M_1$, $M_2$, $M_3$ and $M_4$ is different from H and the $C_1$–$C_4$ alkyl group, in the formula of monomer II.

The preferred polyelectrolytes are mentioned hereinafter, namely:

(i) the derivatives of the polyacrylic type responding to the general formula

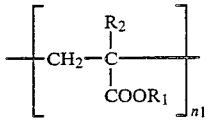

(II.1)

(wherein $R_1$ is H, $C_1$–$C_4$ alkyl, $Na^+$, $K^+$ or $NH_4^+$, $R_2$ is H or $C_1$–$C_4$ alkyl and $n_1$ is an integer higher than or equal to 2) and mixtures thereof;

(ii) the derivatives of the polymaleic type responding to the general formula

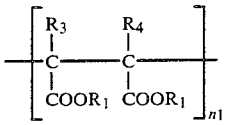

(II.2)

(wherein $R_3$ and $R_4$, which may be identical or different, each represent an atom of hydrogen or a $C_1$–$C_4$ alkyl group, and $R_1$ and $n_1$ are defined as indicated above) and mixtures thereof;

(iii) the derivatives of the polyacrylamide type responding to the general formula

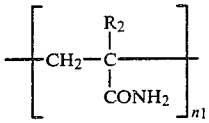

(II.3)

(wherein $R_2$ and $n_1$ are defined as indicated above) and mixtures thereof;

(iv) the copolymer derivatives of the acrylic-acrylamide type schematically presenting a moeity

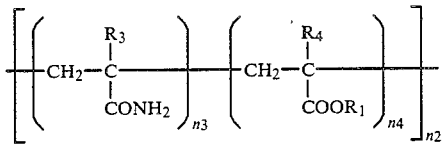

(II.4)

(wherein $R_1$, $R_3$ and $R_4$ are defined as indicated above, $n_2$ is an integer higher than or equal to 1, and $n_3$ and $n_4$, which are identical or different, are integers higher than or equal to 1, one of the $n_3$ and $n_4$ being able to represent 0 in the case of a sequenced copolymer) and mixtures thereof;

(v) the copolymer derivatives of the styrene-maleic type schematically presenting a moeity

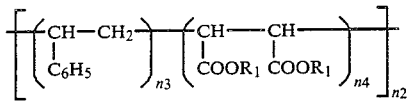

(II.5)

(wherein $R_1$, $n_2$, $n_3$ and $n_4$ are defined as indicated above) and mixtures thereof.

(vi) the copolymer derivatives of the acrylic-acrylamide type schematically presenting a moeity

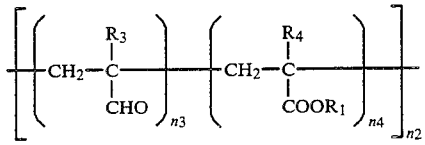

(II.6)

(wherein $R_1$, $R_3$, $R_4$, $n_2$, $n_3$ and $n_4$ are defined as indicated hereinabove) and mixtures thereof.

Among the suitable aminoalkylenephosphonic and alkylenepolyphosphonic acid derivatives, particular mention may be made of the acids of formula III.1, III.2 and III.3 hereinafter, their esters and salts, and mixtures thereof, namely:

(i) the aminoalkylenephosphonic acids of the general formula

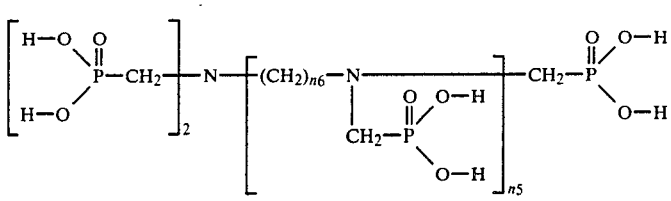

(III.1)

(wherein $n_5$ represents an integer included between 0 and 4; and $n_6$ represents an integer included between 1 and 6), their salts with mono- or polyvalent metallic ions, such as $Na^+$, $K^+$, $NH_4^+$; one of the preferred products of formula III.1 being the sodium aminotrimethylenephosphonate (where $n_5$ is 0)

(ii) the alkylenediphosphonic acids, their esters and salts, such as in particular 1-hydroxyethylidene-1,1-diphosphonic acid of formula

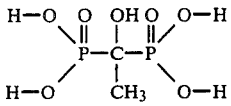

(III.2)

and its salts of sodium, potassium or ammonium; and (iii) the aminoalkylenepolyphosphonic acids of formula

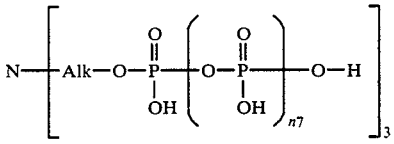

(III.3)

(wherein Alk is a $C_1$–$C_6$ alkylene group, and $n_7$ is an integer included between 0 and 3), their metal or ammonium salts.

Table I hereinafter gives a certain number of examples of corrosion inhibitors according to the invention. These examples which are in no way limiting have been given solely by way of illustration.

TABLE I

| Example | Means | Quantity (parts by dry weight) |
|---|---|---|
| Ex. 1 | fluorophosphate of zinc ($ZnPO_3F$) | 1 |
| Ex. 2 | fluorophosphate of potassium ($K_2PO_3F$) | 1 |
| Ex. 3 | $ZnPO_3F$ | 10 |
| | aminotrimethylenephosphonate of potassium | 10 |
| | oleyaminopropyleneamine | 2 |
| Ex. 4 | $ZnPO_3F$ | 5 |
| | aminotrimethylenephosphonate of potassium | 10 |
| | oleyaminopropyleneamine | 2 |
| Ex. 5 | $ZnPO_3F$ | 2.5 |
| | aminotrimethylenephosphonate of sodium | 10 |
| | stearylaminoethyleneamine | 2 |
| Ex. 6 | $ZnPO_3F$ | 10 |
| | polyacrylic acid (PMM = 700) | 10 |
| | polyacrylate of sodium (PMM = 700) | 40 |
| Ex. 7 | $ZnPO_3F$ | 5 |
| | polyacrylic acid (PMM = 500) | 10 |
| | polyacrylate of sodium (PMM = 2500) | 40 |
| Ex. 8 | $ZnPO_3F$ | 10 |
| | polyacrylic acid (PMM = 750) | 50 |

TABLE I-continued

| Example | Means | Quantity (parts by dry weight) |
|---|---|---|
| Ex. 9 | $K_2PO_3F$ | 10 |
| | aminotrimethylenephosphonate of potassium | 15 |
| Ex. 10 | $ZnPO_3F$ | 2.5 |
| | aminotrimethylenephosphonate of potassium | 15 |

Note:
PPM = mean molecular weight

The products of Examples 1 and 2 are put in the form of aqueous compositions by suspending $ZnPO_3F$ or $K_2PO_3F$ in water; a composition containing 12 g/l of $ZnPO_3F$ or $K_2PO_3F$ will be used which is diluted at the moment of use in the corrosive medium. The products of Examples 3–7 are prepared by introducing $ZnPO_3F$ in the mixture of the other two means, said mixture having been obtained according to the modi operandi described in the European Patent and European Patent Application mentioned above. The products of Examples 8–10 are prepared by introducing in water $ZnPO_3F$ or $K_2PO_3F$ with polyacrylic acid or potassium aminotrimethylenephosphonate.

When a composition containing a means A and a substance B is used, a composition comprising:

1 to 15 parts by weight of means A, and 1 to 100 parts by weight of substance B will advantageously be employed.

The tests carried out with the products according to the invention have been summarized hereinafter.

I - Direct measurement of the corrosion by determining the loss of weight of test pieces (a) Equipment and modus operandi The equipment and modus operandi relative to the determination of the loss of weight of the test pieces by direct measurement of the gravimetric type, are those described in European Patent No. 10485 mentioned above.

Tests were undertaken on test pieces made of steel, copper and/or aluminium with raw water "A" (drilling water) and synthetic water "B" which is very corrosive due to the presence of chlorides and dissolved oxygen obtained by total demineralization of the raw water "A" by passage over ion exchanger resins then addition of 200 mg/l of sodium chloride. Waters A and B had the following characteristics given in Table II.

TABLE II

| Characteristics | Raw water "A" | Synthetic water "B" |
|---|---|---|
| pH | 6.6 | 7.2 |
| Hydrotimetric titer TH | 12° French | 0° French |
| Alkalimetric titer TA | 0° French | 0° French |
| Full alkalimetric titer TAC | 5.6° French | 0.5° French |
| Strong acid titer TAF | 8.2° French | 17° French |
| Sodium (in $Na^+$) | 5.8 mg/l | 78.6 mg/l |
| Chlorides (in $Cl^-$) | 1.3° French | 121.3 mg/l |

TABLE II-continued

| Characteristics | Raw water "A" | Synthetic water "B" |
|---|---|---|
| Sulfates (in $SO_4^{--}$) | 6° French | 0° French |
| Nitrates (in $NO_3^-$) | 0.87° French | 0° French |
| Iron (in $Fe^{++}$) | 0.15 mg/l | 0° French |
| Oxygen | saturation | saturation |
| Resistivity ($\Omega \cdot cm^{-1}$) | 7840 | 2495 |

Measurement of the loss of weight was carried out in tests of the "heat" type and of the "cold" type. To simplify reading of the results, the loss of weight has been translated into speed of corrosion V (expressed in $\mu$/p.a.) and into inhibitory efficiency E% (percentage of inhibition) according to the relations $$V=(P\times 365)/(J\times S\times d)$$

in which

V=speed of corrosion in $\mu$/p.a. (ie. in $\mu$/year)

P=loss of weight in mg

J=number of days of exposure to the agressive medium

S=outer surface of the test piece in $\mu^2$ d=specific mass of the metal of the test piece in mg/$\mu^3$; and $$E\%=[(Vo-V)/Vo]\times 100$$

in which Vo and V respectively represent the speeds of corrosion (expressed in $\mu$/p.a.) without and with inhibitor.

(b) Results

The results obtained are shown in Tables III, IV and V hereinbelow.

These results show that the fluorophosphates according to the invention and their associations with polyamines, aminoalkylenepolyphosphonic acid derivatives, and/or organic polyelectrolytes inhibit very effectively the aqueous corrosion of metallic surfaces.

TABLE III

Corrosion tests of the "cold" type
corrosive medium: synthetic water B
temperature: 20° C.
duration of the tests: 50 hrs.

| Product | | corrosion steel | |
|---|---|---|---|
| Nature | dose (in ppm) (a) | $\mu$/p.a. | E % |
| control | 0 | 1142 | 0 |
| Example 1 | 6.25 | 223 | 80.67 |
| | 12.5 | 39.5 | 96.54 |
| | 25 | 16.5 | 98.54 |
| | 50 | 74.3 | 93.49 |
| | 100 | 83.2 | 98.11 |
| | 200 | 74.3 | 93.49 |
| Example 3 | 50 | 42.5 | 96.28 |
| | 100 | 55.4 | 95.15 |
| Example 4 | 50 | 43 | 96.23 |
| | 100 | 62.5 | 94.53 |
| Example 5 | 50 | 50.1 | 95.61 |
| | 100 | 51.9 | 95.46 |
| Example 6 | 60 | 122.1 | 89.31 |
| Example 7 | 55 | 89.7 | 92.15 |
| Example 8 | 52.5 | 142.2 | 87.55 |
| Example 9 | 60 | 95 | 91.68 |
| Example 10 | 55 | 230.7 | 79.86 |

Note
(a) = dose in dry matter

TABLE IV

Corrosion tests of the "cold" type
corrosive medium: raw water A
temperature: 20° C.
duration: 50 hrs.

| Product | | Corrosion | | | | | |
|---|---|---|---|---|---|---|---|
| | dose (in ppm) | Steel | | Copper | | Aluminum | |
| Nature | (a) | $\mu$/p.a. | E % | $\mu$/p.a. | E % | $\mu$/p.a. | E % |
| Control | 0 | 1264 | 0 | 7 | 0 | 28 | 0 |
| Example 1 | 5 | 145.7 | 88.47 | 5.54 | 20.86 | 20.5 | 26.79 |
| | 10 | 17.7 | 98.60 | | | | |
| Example 3 | 50 | 9.4 | 99.26 | 2.1 | 70 | 14.8 | 47.14 |

Note
(a) = dose expressed in dry matter

TABLE V

Corrosion tests of the "heat" type
corrosive medium: raw water A
temperature: 50° C.
duration: 50 hrs.

| Product | | Corrosion | | | | | |
|---|---|---|---|---|---|---|---|
| | dose in ppm | Steel | | Copper | | Aluminum | |
| Nature | (a) | $\mu$/p.a. | E % | $\mu$/p.a. | E % | $\mu$/p.a. | E % |
| Control | 0 | 1550 | 0 | 25 | 0 | 38 | 0 |
| Example 2 | 125 | 542.5 | 65 | 14.75 | 41 | 0.84 | 82 |
| | 250 | 434 | 72 | 8.75 | 65 | 4.94 | 87 |
| | 500 | 75.5 | 95 | 0.25 | 83 | 0.76 | 98 |

Note
(a) = dose expressed in dry matter

II - Study of the inhibition of aqueous corrosion by means of $ZnPO_3F$ as a function of the pH With the synthetic water B described hereinabove, the inhibition of the aqueous corrosion of steel test pieces by means of $ZnPO_3F$ (product of Example 1) as a function of the pH was studied. The technique of measuring the loss of weight of the test pieces, on the one hand, and the determination of the speed of corrosion and the anticorrosive effectiveness, on the other hand, which was carried out is that used above.

In these tests $ZnPO_3F$ was used at the dose of 25 ppm. The results are shown in Table VI.

TABLE VI

Corrosion tests as a function of the pH
Agressive medium: synthetic water B
Corrosion inhibitor: $ZnPO_3F$ at the dose of 25 ppm
temperature: 20° C.
duration: 50 hrs.

| | | Corrosion steel | |
|---|---|---|---|
| Product | pH | $\mu$/ | E % |
| Control | 7.2 (a) | 1142 | 0 |
| $ZnPO_3F$ | 7.2 (a) | 16.5 | 98.5 |
| | 8 (b) | 35.4 | 96.9 |
| | 9 (b) | 23 | 97.9 |
| | 10 (b) | 5.84 | 99.5 |

Notes
(a) pH without addition of NaOH
(b) pH adjusted by addition of NaOH

III - Inhibition of the corrosion of an oil well

Into the annular space of a steel oil well operating in pumping mode and having a length of 2500 meters are injected the products of Examples 1, 3 and 6 in the aqueous mud so that the content of the products of said examples is included between 20 and 150 ppm. It is observed that the speed of corrosion expressed in $\mu$/p.a. is considerably reduced with the products of Examples 1, 3 and 6 with respect to the control (injection of aqueous mud alone).

What is claimed is:

1. A method for protecting metallic surfaces which are in contact with a corrosive aqueous energic or thermic fluid and tend to be corroded thereby which comprises incorporating in said fluid between 3 and 500 ppm by weight of a fluorophosphate compound corrosive inhibitor selected from the group consisting of:

(i) compound of the formula $M_2^{I}PO_3F$, $xH_2O$ (ii) compound of the formula $LiM^{I}PO_3F$, $xH_2O$ (iii) compound of the formula $NaM^{I}PO_3F$, $xH_2O$ (iv) compound of the formula $M^{II}PO_3F$, $xH_2O$ (v) compound of the formula $M_2^{I}M^{II}(PO_3F)_2$, $xH_2O$ (vi) compound of the formula $M^{I}PO_2F_2$, $xH_2O$ (vii) compound of the formula $M^{II}(PO_2F_2)_2$, $xH_2O$ and (viii) mixtures thereof ;wherein $M^{I}$ is Na, K, Rb, Cs or $HN_4$; $M^{II}$ is Mg, Ca, Ba, Sr, Zn, Cd, Mn, Ni or Co; and x is an integer or a fractional number comprised between 0 and 6.

2. A method according to claim 1 in which the corrosion inhibitor is zinc fluorophosphate.

3. A method according to claim 1 in which the corrosion inhibitor is potassium fluorophosphate.

4. A method according to claim 1 in which said corrosive fluid also contains a substance (B) selected from the group consisting of polyamines, organic polyelectrolytes resulting from polymerization and copolymeriation of a monomer having a C=C double bond, alkylenephosphonic acid derivatives, aminoalkylene phosphonic acid derivatives and mixtures thereof.

5. A method according to claim 4 in which there is from 1–100 parts dry weight of substance (B) per from 1–15 parts dry weight of fluorophosphate.

6. A method according to claim 1 in which the corrosive fluid contains zinc fluorophosphate in an amount between 5 and 200 ppm by weight.

* * * * *